United States Patent [19]

Bowers et al.

[11] Patent Number: 4,813,862

[45] Date of Patent: Mar. 21, 1989

[54] DISPENSER PACKAGE FOR EXTRUDABLE COMESTIBLES

[76] Inventors: Paul K. Bowers, 14 Chandler Ct., Plainsboro, N.J. 08536; Richard A. Kennedy, RD#1, Box 209, Zion Rd., Neshanic, N.J. 08853; Timothy G. Murray, 901 Taylorsville Rd., Washington Crossing, Pa. 18977; Richard S. Kunkle, 211 Windsor Commons, Cranbury, N.J. 08512

[21] Appl. No.: 905,594

[22] Filed: Sep. 9, 1986

[51] Int. Cl.[4] ..... B65D 37/00

[52] U.S. Cl. ..... 425/87; 222/92; 222/107; 222/131; 229/1.5 B; 229/4.5; 229/5.5; 383/111; 383/112; 383/906; 383/907; 425/376.1

[58] Field of Search ..... 425/376 R, 87, 376.1; 222/107, 92, 131; 383/107, 111, 112, 116, 118, 906, 121, 105, 902, 907; 229/4.5, 5.5, 1.5 E, 48 T

[56] References Cited

U.S. PATENT DOCUMENTS

| | | | |
|---|---|---|---|
| 484,937 | 10/1892 | Megson | 425/131.1 |
| 1,294,011 | 2/1919 | Williams | 229/4.5 |
| 2,099,412 | 11/1937 | Seidler | 222/107 |
| 2,104,535 | 1/1938 | Barbieri | 229/4.5 |
| 2,207,003 | 7/1940 | Dunlap | 229/4.5 |
| 2,267,246 | 12/1941 | Meade | 229/4.5 |
| 2,320,496 | 6/1943 | Wechsler | 222/107 |
| 2,363,148 | 11/1944 | Rosen | 222/107 |
| 2,467,016 | 4/1949 | Dunlap | 229/4.5 |
| 2,540,565 | 2/1951 | Barbieri | 229/4.5 |
| 3,282,411 | 11/1966 | Jardine | 383/107 |
| 4,205,765 | 6/1980 | May | 222/107 |
| 4,574,987 | 3/1986 | Halligan et al. | 222/107 |

FOREIGN PATENT DOCUMENTS

| | | | |
|---|---|---|---|
| 481081 | 2/1952 | Canada | 229/4.5 |

*Primary Examiner*—Willard E. Hoag
*Attorney, Agent, or Firm*—Thomas R. Savoie

[57] ABSTRACT

A collapsible package for extrudable comestibles, such as soft-frozen ice cream, includes a cone-shaped laminated body portion comprised of inner polymer film ply bonded to a structural ply, a nozzle secured at the top of the cone-shaped body portion and a cap or cover across the nozzle aperture. The bond between the polymer film and the structural ply is strippable and has a bond strength of between 65 and 300 grams/inch.

10 Claims, 1 Drawing Sheet

DISPENSER PACKAGE FOR EXTRUDABLE COMESTIBLES

TECHNICAL FIELD

The present invention relates to a package for dispensing extrudable comestibles. More particularly, the present invention relates to hand-held collapsible packages containing extrudable comestibles which package may be squeezed by the consumer so as to extrude the contents through an orifice in the package.

Hand-held dispenser packages which may be squeezed and collapsed either by means of direct hand pressure or pressure exerted by means of a mechanical device such as a wind-up key or roller are well-known in the art. These packages, such as toothpaste tubes, are typically made of relatively expensive materials such as metal foils or heavy gauge plastics so as to withstand the rather substantial pressures which are exerted on the package during the dispensing process. These packages are costly to produce and would not be suitable for marketing and dispensing small, for example, single servings, of extrudable food materials such as soft-frozen comestibles.

Recently, there have been developed several versions of frozen dessert products such as ice creams and ice milks which maintain a soft, extrudable consistency during freezer storage in the range of 0° to 15° F.

Such products are disclosed in U.S. Pat. Nos. 4,145,454 to Dea et al., 4,224,977 to Kahn et al., 4,400,405 and 4,440,406 to Morley et al. and 4,374,154 to Cole et al. All of these products which have a moisture content in excess of 30% by weight are designed to be consumed directly from the freezer and provide a soft ice cream eating experience in the home environment. It would be desirable to package such products in small volume, disposable and collapsible packages whereby the consumer could intermittently squeeze essentially all of the product from the package, thus providing a hand-held frozen confection.

A package which has been designed for such use, as described in U.S. Pat. No. 4,574,987, comprises a collapsible cone-shaped body portion, which includes cone-shaped, heat-sealable plastic liner spot-bonded to an external cone-shaped paper jacket, and a circular extrusion nozzle which is recessed within and heat sealed to the cone-shaped body portion. Such a package has proven to be quite effective to enable the consumer to squeeze or collapse the body portion of the cone and extrude the contents through the nozzle in a controlled manner. Unfortunately such a package is both complex and expensive to produce. It was heretofore thought necessary to utilize such a two-piece or dual cone body portion so that the package would avoid rupture and tearing during the dispensing or extrusion process.

A comparable cone-shaped package wherein the body portion was comprised of paper which had been extrusion-coated with polyethylene was found to be suseptible to rupture as a result of the forces exerted during extrusion of a soft ice cream product.

SUMMARY OF THE INVENTION

According to this invention a hand-held extruder package is fabricated, said package being comprised of a collapsible, single-piece, preferably cone-shaped body portion which is secured to a pre-formed, circular fitment, which fitment contains both an extrusion orifice through which the package contents are dispensed and a rim around its periphery which enables the body portion to be secured to the fitment. The package is also provided with a closure means which covers the extrusion orifice so that the package contents will be protected against contamination. The collapsible body portion is comprised of a laminate which contains a moisture resistant outer ply or coating which will constitute the exterior surface of the package, a central, preformed, essentially non-stretchable ply which provides the structural stability for the body portion and an inner ply of a heat-sealable, stretchable polymer film which will contact the comestible. A critical feature of this laminate is the fact that the inner ply of polymeric film adheres to the central ply with a bond strength of between 65 and 300 grams/inch, preferably between 90 and 250 grams/inch, as measured by test method No. F904 of The American Society for Testing and Materials (ASTM). Such a bond strength may be qualitatively characterized by the fact that the plys may be pulled apart by hand without tearing the plys.

According the ASTM No. F904 the plies of a test specimen are separated at one end by the application of heat. A 25.4 mm wide and 127 mm long sample is then cut from the test specimen and the freed ends of the sample are clamped in a tensile testing machine, such as an Instron, which has the jaw separation set at 305 mm/min ±10%.

Typically the body portion is cone-shaped and formed from a laminate of coated paper and a heatsealable plastic film. The cone may be formed according to conventional cone making techniques making use of equipment which is commercially-available. When fabricating spiral wrapped cones, such as known in the art, the cone may be sealed along its spiral seam by means of a hot melt adhesive and/or by heat activating the polymer film. Of course, any type of fabricated cone body would be useful in the practice of this invention.

For purposes of clarity the body portion will be hereinafter referred to as being cone shaped and the preformed fitment will be referred to as being circular. It is to be understood however that the body portion could be another shape such as an elongated tube having a circular or polygonal (e.g., square) cross-section with the periphery of the fitment being shaped to match the cross-section of the body portion.

For spirally-wrapped, cone-shaped body portions, it may be desirable to form an additional heat seal at or adjacent the apex of the cone. This could be conveniently done by passing the tip of the cone between two heated roller members or by the use of reciprocating heat sealing jaws or bars. Such a heat seal which should extend across the width of the cone at or adjacent the apex will insure against leakage from the cone bottom during extrusion of the contents.

It will be necessary to secure the fitment to the cone-shaped body portion of the package in a manner which will withstand the considerable stresses to which the package is subjected during the process of dispensing the soft-frozen comestible through the extrusion orifice. In order to effect this type of secure engagement between the fitment and the body portion it has been found desirable to seat the fitment within the cone-shaped body portion. Typically the upstanding rim portion of the fitment is recessed below the upper edge of the body portion which edge is thereafter folded around the upstanding rim of the fitment. Various heat-sealing, bonding and/or crimping techniques may be employed to produce a seal and/or engagement which will withstand the forces encountered during the extrusion process.

Desirably the upstanding fitment rim is outwardly tapered at an angle which essentially matches the angle of the cone-shaped body portion of the package. In this manner the fitment may be more readily seated within the body portion.

The comestible material may be supplied to the body assembly either before or after the fitment is secured in place. A removable closure, which may be a snap-on cap, an adhesive sheet or label, an induction sealable metal foil or the like will be used to cover the orifice in the fitment. If the fitment is secured to the body assembly before filling with the comestible, the closure will be put into place after filling. If on the other hand the body assembly is filled before the fitment is secured, the cover may be placed on the fitment either before or after the fitment is secured to the body assembly.

The invention will be readily apparent to those skilled in the art upon a reading of the description of the preferred embodiments below when taken in conjunction with the accompanying drawings.

BRIEF DESCRIPTION OF THE DRAWINGS

In the accompanying drawings which are given to illustrate and exemplify the invention but not to limit the invention.

DESCRIPTION OF THE PREFERRED EMBODIMENTS

Figure 1:
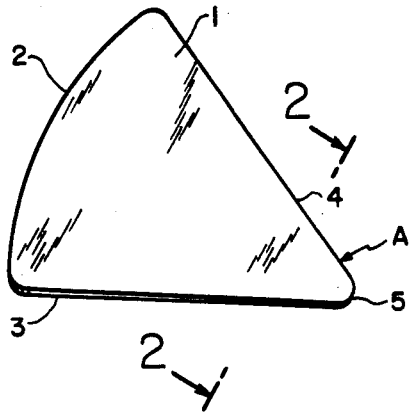
FIG. 1 is a view of a blank suitable for being formed into a cone-shaped body portion.

Referring to the drawings, FIG. 1 depicts a laminated cone blank 1 which may be spiral wound about a mandrel to form a cone-shaped body portion for use in the dispenser package of this invention. The blank is depicted as having a shape that may be defined as an off-center segment of a circle having a arcuate or curved outer edge 2 which will define the mouth of the wrapped cone. Curved edge 2 terminates in inwardly converging side edges 3 and 4 which are of unequal length and which are connected at the apex of the circle segment with curved edge 5. Curved edge 2 is drawn as the arc of a circle centered at point A.

Figure 2:
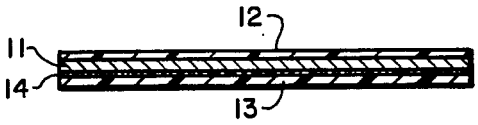
FIG. 2 is a cross-sectional view of FIG. 1 showing the construction of the laminate.

FIG. 2 depicts the laminated structure of cone blank 1 showing structural ply 11, depicted here as being paper, coated on outer side (i.e., the surface which will form the exterior of the cone) with a moisture resistant film or coating 12 and bonded on the inner side to a polymeric film 13 by means of a heat and/or pressure sensitive adhesive layer 14. Structural ply 11 will be comprised of an essentially non-stretchable web material such as paper, preferably a machine finished paper which has a tear strength in both the machine and cross-directions of at least 90 grams/cm. The term tear strength as used herein refers to a value obtained utilizing the standardized methodology ASTM D 1922 adopted and published by the American Society of Material Engineers. Structural ply 11 should be of a weight or gauge so as to permit the fabricated cone to be self-sustaining and capable of being nested, de-nested and/or conveyed by conventional mechanical equipment.

Moisture-resistant coating 12 may be any food-approved polymer coating such as a vinyl chloride-vinylidene chloride copolymer, nitrocellulose, or the like. Coating 12 may be applied to ply 11 by means of well-known extrusion, dispersion or other coating techniques. Such a coating is for the purpose of protecting structural layer 11 from moisture which may be present due to condensation of atmospheric moisture or moisture transferred from the hand of the consumer.

Polymeric film 13 is a heat-sealable film such as polyolefin and polyester homopolymers and copolymers. Polyethylene and ethylene-methyl acrylate are examples of "suitable films" for use in this invention. The use of plasticizers in the film composition in order to increase the stretchability of the film or the use of a film which inherently has a relatively high level of stretchability is believed to be desirable.

Film 13 is bonded to substrate 11 in such a manner that the two plys are strippable one from the other. In qualitative terms the strippable bond referred to in this invention may be characterized as one wherein, after the plys are separated at an edge of the cone blank, the two plys be delaminated, essentially intact, by pulling or stripping one from the other. In quantitative terms, the strippable bond of this invention is characterized as one wherein the bond strength in grams/inch ranges between 65and 300 preferably from 90 to 250, as measured by ASTM No. 825. Such a bond may be effected by means of an adhesive layer 14 or via various extrusion coating techniques all of which are known to those skilled in the art.

The use of bond inhibitors in the film composition or coated onto the substrate may be employed in order to form a strippable bond from an extrusion coating operation. An appropriate heat and/or pressure-activated adhesive layer 14, such as a polyvinyl acetate or polyvinylidene chloride copolymer-based adhesive or other adhesives may also be utilized to bond plys 11 and 13 together using various combinations of heat and pressure which will be readily ascertained by those skilled in the art. Use of a pressure-sensitive adhesive such as vinyl acetate monomer may also be employed.

Figure 3:
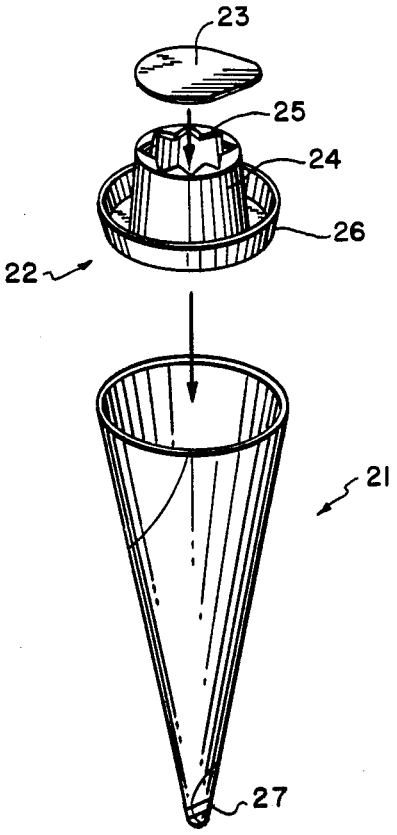
FIG. 3 is an assembly drawing in perspective of the package of this invention showing the separate elements of the package.

FIG. 3 depicts the elements which are used to fabricate a dispenser package for extrudable comestibles in accordance with the preferred embodiments of this invention. These elements include a wrapped cone body member 21, a preformed extrusion fitment 22 and a closure 23. The fitment is depicted having a raised central portion 24 which is in the shape of a truncated cone and an extrusion orifice or aperture 25 located on the planar face of the raised central portion 24. The fitment is depicted with an upstanding rim 26 around its outer circumference or periphery. This upstanding rim 26 provides a surface to bond or secure the cone to the fitment. It would, of course, be possible for the fitment to possess a flat central portion (not shown) such that the extrusion orifice would be recessed within the upstanding rim of the fitment. At the bottom of the cone there is shown a crimped area 27 which indicates a reinforcing heat seal formed in the apex of the cone.

Fitment 22 may be fabricated from any material which will result in a self-sustaining structure. Typically the fitment will be of molded plastic and be heat sealed to body member 21. Closure 23 is depicted as a film or foil which may be secured across extrusion orifice 25 by heat sealing or induction sealing techniques.

Alternatively the closure may be in the form of a cap such as a preformed, snap-on cap.

Having thus described the invention, what is claimed is:

1. A collapsible hand-held package for dispensing extrudable comestibles said package comprised of a preformed fitment containing an extrusion orifice and a collapsible body portion bonded to said fitment, said body portion being formed from a laminate of an essentially non-stretchable structural ply bonded to a heat-sealable and stretchable polymer film ply which will contact the extrudable comestible, the bond between the structural ply and the film being effective to produce a laminate which may be delaminated by stripping the polymer film from the structural ply without tearing either ply and wherein the laminate has a bond strength of from 65 to 300 grams/inch.

2. The package of claim 1 wherein the body portion is in the shape of an open-ended cone which is bonded to a circular plastic fitment at its open end.

3. The package of claim 2 wherein the cone-shaped body portion has a wound blank configuration and has a transverse heat seal at the closed apex end which heat seal effectively prevents leakage from the apex end.

4. The package of claim 1 wherein the polymer film is adhesively bonded to the structural ply by means of an adhesive layer.

5. The package of claim 3 wherein the cone-shaped body portion is of a wound spirally blank configuration.

6. The package of claim 5 wherein the cone-shaped body portion contains an overlapped spiral seam which is sealed by means of a hot melt adhesive.

7. The package of claim 1 wherein the structural ply consists of paper.

8. The package of claim 7 wherein the structural ply is coated on the side opposite from the polymer film with a moisture resistant coating.

9. The package of claim 7 wherein the bond strength between the polymer film and the structural ply is from 90 to 250 grams/inch.

10. The package of claim 1 wherein the polymer film is extrusion coated on the structural ply.

* * * * *